US009333391B2

(12) United States Patent
Godoy

(10) Patent No.: US 9,333,391 B2
(45) Date of Patent: May 10, 2016

(54) HEEL STRAP FOR OPEN FOOT SWIMMING FINS

(71) Applicant: CRESSI-SUB S.P.A., Genoa (IT)

(72) Inventor: Carlos Alberto Godoy, Genoa (IT)

(73) Assignee: CRESSI-SUB S.P.A., Genoa (IT)

( * ) Notice: Subject to any disclaimer, the term of this patent is extended or adjusted under 35 U.S.C. 154(b) by 0 days.

(21) Appl. No.: 14/606,172

(22) Filed: Jan. 27, 2015

(65) Prior Publication Data

US 2015/0209620 A1 Jul. 30, 2015

(30) Foreign Application Priority Data

Jan. 28, 2014 (IT) ..... GE2014A0007

(51) Int. Cl.
*A63B 31/11* (2006.01)
*A63B 31/08* (2006.01)

(52) U.S. Cl.
CPC ..... *A63B 31/11* (2013.01)

(58) Field of Classification Search
CPC ..... A63B 31/08
USPC ..... 441/63–64
See application file for complete search history.

(56) References Cited

U.S. PATENT DOCUMENTS 4,832,644 A * 5/1989 Roberts ..... A63B 31/11 36/11.5
5,183,424 A * 2/1993 Field ..... A63B 31/11 441/64
5,304,081 A * 4/1994 Takizawa ..... A63B 31/11 441/64
5,545,067 A * 8/1996 Garofalo ..... A63B 31/11 441/64
5,597,336 A * 1/1997 Evans ..... A63B 31/11 441/61
5,607,334 A * 3/1997 Garofalo ..... A63B 31/11 441/64
5,683,279 A * 11/1997 Raasch ..... A63B 31/11 441/64
5,722,867 A * 3/1998 LaGrow ..... A63C 13/001 441/70

(Continued)

FOREIGN PATENT DOCUMENTS

EP 2433680 3/2012
FR 957149 2/1950

(Continued)

OTHER PUBLICATIONS

Search Report and Written Opinion for Italian Application No. GE20140007; Sep. 24, 2014; 7 pages.

*Primary Examiner* — Lars A Olson
*Assistant Examiner* — Jovon Hayes
(74) *Attorney, Agent, or Firm* — Stetina Brunda Garred & Brucker

(57) ABSTRACT

Heel strap (2) for swimming fins (1) with an open foot pocket (101), characterized in that it comprises a tubular element (3) made of elastomeric material with a hole (103) and end elements (4, 8) for coupling to the foot pocket (101) of the fin (1), each end element (4, 8) being provided with a seat (404, 408) in which at least one constriction (504, 508) is produced and through which, on one side, an end of the tubular element (3) is inserted, which is consequently elastically compressed at said constriction (504, 508) and expands after passing through the same, there being inserted on the other side of said seat (404, 408) and of said constriction (504, 508) an element (7) for locking the length of tubular element (3) that has passed through said constriction (504, 508) in the hole (103), so as to elastically expand it and to prevent, in combination with said constriction (504, 508), said tubular element (3) from being separated from said end coupling elements (4, 8) to which it is thereby permanently coupled.

10 Claims, 5 Drawing Sheets

(56) References Cited

U.S. PATENT DOCUMENTS 6,109,990 A * 8/2000 Lundberg ..... A63B 21/0084 441/64
6,129,601 A * 10/2000 Aucoin ..... A63B 31/11 441/64
6,152,794 A * 11/2000 Liu ..... A63B 31/11 441/64
6,159,064 A * 12/2000 Takeuchi ..... A63B 31/11 441/61
6,185,794 B1 * 2/2001 Maggi ..... A63B 31/11 24/170
6,227,924 B1 * 5/2001 Miller ..... A63B 31/11 441/64
6,341,383 B1 * 1/2002 Beltrani ..... A63B 33/002 2/452
6,398,604 B1 * 6/2002 Kawashima ..... A63B 31/11 441/64
6,435,926 B1 * 8/2002 Yeh ..... A63B 31/11 441/64
6,663,452 B1 * 12/2003 Myers ..... A63B 31/11 441/64
6,702,633 B1 * 3/2004 Johnson ..... A63B 31/11 441/64
6,884,136 B1 * 4/2005 McCarthy ..... A63B 31/11 441/64
6,923,697 B1 * 8/2005 Wagner ..... A63B 31/11 36/58.6
6,955,575 B1 * 10/2005 Hsieh ..... A63B 31/11 441/64
8,986,061 B2 * 3/2015 Fraser ..... A63B 31/11 441/64
2003/0027469 A1 * 2/2003 Testa ..... A63B 31/11 441/64
2003/0232550 A1 * 12/2003 Wagner ..... A63B 31/11 441/64
2009/0137166 A1 * 5/2009 Melius ..... A63B 31/11 441/64
2010/0255964 A1 * 10/2010 Wang ..... A63B 21/00043 482/122
2012/0071047 A1 * 3/2012 Noceti ..... A63B 31/11 441/64
2015/0209620 A1 * 7/2015 Godoy ..... A63B 31/11 441/63

FOREIGN PATENT DOCUMENTS

WO WO0225162 3/2002
WO WO2008117745 10/2008

* cited by examiner

HEEL STRAP FOR OPEN FOOT SWIMMING FINS

CROSS REFERENCE TO RELATED APPLICATIONS

The present application claims priority to Italian Patent Application No. GE2014A000007 filed Jan. 28, 2014, the entirety of the disclosures of which are expressly incorporated herein by reference.

STATEMENT RE: FEDERALLY SPONSORED RESEARCH/DEVELOPMENT

Not Applicable.

BACKGROUND OF THE INVENTION

The present invention relates to a heel strap for swimming fins of the open foot or open heel type.

As is widely known, open foot fins are provided at the front with a blade and at the back with an open foot or open heel, into which the scuba diver's foot is inserted. To maintain the foot in the correct position inside the fin, straps are provided, having the function of encircling the scuba diver's heel with the correct tension, so as to maintain the scuba diver's foot in position inside the fin. These straps can be made in various ways; for example, they can be provided with elastomeric belts or tubular elements that are connected at the sides of the foot pocket of the fin by means of buckles or eyelet elements adapted to engage with pins projecting from the fin. According to some types of prior art straps, the ends of the tubular element made of elastomeric material are removably connected to sorts of eyelets that are then coupled to these pins projecting from the foot pocket of the fin.

These prior art straps have various problems relating above all to stable fastening of the tubular element made of elastomeric material to the means for coupling to the fin and relating to the efficiency and safety of the method of coupling these eyelet means to the pins projecting from the fin.

SUMMARY OF THE INVENTION

The main object of the present invention is to produce a heel strap for open foot fins that uses a tubular element made of elastomeric material firmly and permanently fastened to end elements for coupling to the foot pocket of the fin. This fastening of the tubular element to the end elements for coupling to the fin must be implemented in a simple, rapid and efficient manner and without the aid of particular tools or other instruments.

This objective is achieved by the present invention by means of a heel strap for open foot fins according to claim 1.

Advantageously, the present strap for open foot fins is fastened in a more stable and efficient manner to the foot pocket of the fin with respect to prior art straps; this fastening is in fact implemented by inserting, with limited effort, each end of the elastomeric tubular element, which in substance is a simple perforated rubber cylinder, inside a seat produced in the relevant end coupling element. This seat has a constriction, which a certain length of the tubular element passes through, being elastically compressed at this constriction and expanding again after having passed through it. On the opposite side with respect to the side on which the end of this tubular element made of elastomeric material is inserted, a rigid locking element is inserted, again with limited effort, inside the hole of the tubular element made of elastomeric material, so as to expand the inner hole of the elastomeric tubular element and consequently to compress the walls. The combined action of the rigid locking element and of the constriction prevent the elastomeric tubular element from being released from the end coupling element; moreover, advantageously, the more the elastomeric tubular element is pulled to try to extract it from the end coupling element, the more the rigid locking element tends to translate towards the inside of the elastomeric tubular element.

Upstream of the rigid locking element inserted in the hole of the elastomeric tubular element a sort of inner ring is formed, starting from the edge, which prevents this rigid element from exiting from the tubular element once it has been inserted. Formation of this inner ring is due simply to the tendency of the inner walls of the elastomeric tubular element to return to the initial configuration once the rigid locking element has passed through and has expanded them elastically.

The rigid locking element can be a wedge comprising a truncated cone shaped part facing the side for insertion of this tubular element made of elastomeric material into the axial through hole. The truncated cone shape of the rigid locking element facilitates its insertion into the elastomeric tubular element.

Once this wedge has been inserted into the tubular element made of elastomeric material, it is advantageously positioned with at least one length of its truncated cone shaped part on the other side of the constriction produced in the seat of the end coupling element.

To facilitate insertion of each of the ends of the elastomeric tubular element, each of these end coupling elements comprises a truncated cone shaped guide part located upstream of the constriction.

These end coupling elements comprise at least one pin provided with radially projecting tabs; these tabs are adapted to be inserted inside a seat produced in the foot pocket of the fin and to be positioned therein following a certain degree of rotation of this end coupling element; each of these end coupling elements are provided with a seat for housing a final element for partial locking adapted to allow a certain degree of oscillation thereof and, at the same time, to prevent it from exiting completely from the relevant seat produced in the foot pocket.

According to a further characteristic of the invention, these final elements for partial locking are provided with means for snap-fitting inside the seats produced in these end coupling elements.

According to an embodiment of the end coupling elements, the final element for partial locking comprises a pin adapted to be snap-fitted into this seat of the end coupling element on the opposite side with respect to the side on which this end coupling element is inserted into the seat produced in the foot pocket.

Preferably, this pin comprises on the stem at least one pair of diametrically opposite ribs adapted to engage in holes produced in diametrically opposite positions at the sides of the seat for passage of the pin, so as to allow a certain degree of oscillation of the end coupling elements.

According to a further embodiment of the end coupling elements, the final element for partial locking comprises a tooth adapted to pass through a hole produced in the seat of the end coupling element and to be inserted in an arc-shaped seat produced on the wall of the open foot pocket; the amplitude of this arc-shaped seat corresponds substantially to the amplitude of the permitted range of oscillation of these coupling elements.

BRIEF DESCRIPTION OF THE DRAWINGS

Further characteristics and advantages of the present invention will be better understood in the following description, provided by way of non limiting example and with reference to the accompanying drawings, wherein.

DETAILED DESCRIPTION OF THE INVENTION

Figure 1:
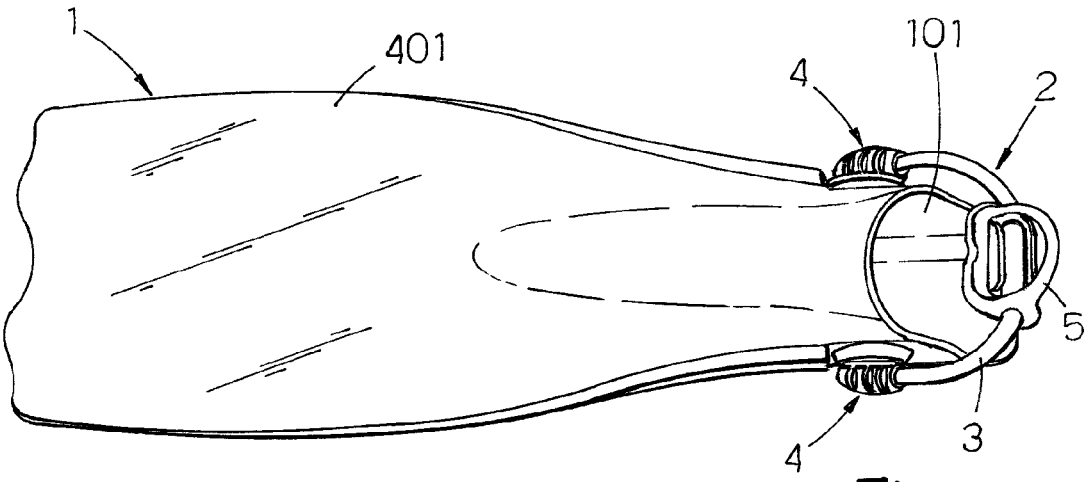
FIG. 1 is a top view of a heel strap for swimming fins according to the present invention comprising a tubular elastic element provided with two end elements for coupling to two opposite lateral walls of the fin.

With reference to the accompanying drawings and with particular reference to FIG. 1 thereof, the number 1 indicates a fin comprising a foot pocket 101 into which the foot is inserted at the back and a blade 401 at the front. A heel strap 2 according to the present invention is positioned at this open foot pocket 101. This strap 2 comprises a tubular element 3 made of elastomeric material provided at the two ends with end elements 4 for coupling to the lateral walls of the foot pocket 101. The strap 2 also comprises a handgrip 5, appropriately shaped and mounted so that it can slide on the tubular element 3 made of elastomeric material.

Figure 2:
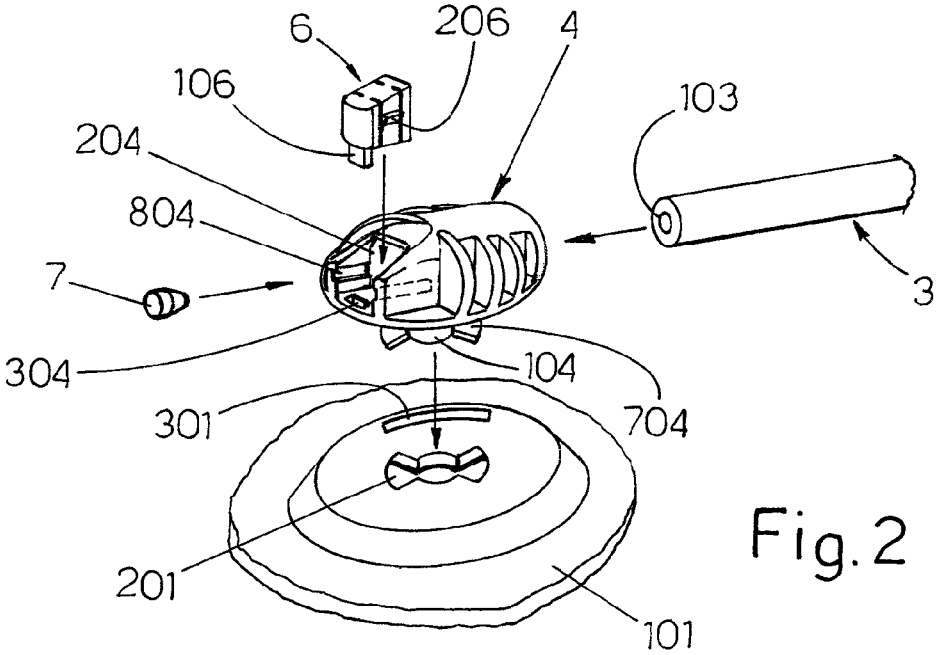
FIG. 2 is a perspective exploded view of a first embodiment of the end elements for coupling of the strap to the fin and of a removable final element for partial locking of these end elements to the fin.

Each of the end coupling elements 4, according to a first embodiment thereof indicated in FIG. 2, comprises at the bottom a pin 104, at the free end of which are produced tabs 704 diametrically opposite and projecting radially therefrom. This pin 104 provided with tabs 704 is adapted to pass through a hole 201 of corresponding shape produced on the lateral wall of the open foot pocket 101. An arc-shaped notch 301 is also produced on this lateral wall of the open foot pocket 101. The tubular element 3 made of elastomeric material is a normal cylinder with an axial through hole 103 adapted to be inserted into the end element 4. This end element 4 has, on the opposite side to that of insertion of this tubular element 3, a seat 204 for insertion of a hollow final element 6 for partial locking. This element 6 for partial locking has a tooth 106 projecting from the bottom and adapted to pass through a through hole 304 produced at the base of the seat 204 of the end coupling element 4. A rigid wedge 7, adapted to be inserted inside the through hole 103 of the tubular element 3, is shown in diametrically opposite position with respect to that of insertion of the end of the elastomeric tubular element 3. This wedge 7 is preferably shaped so as to have a truncated cone shaped end on the side of insertion into through hole 103 of the tubular element 3 made of elastomeric material. Once inserted, the element 6 for partial locking will cover the side of the seat 204 from which the wedge 7 is inserted.

This first embodiment of the end coupling element 4 is preferably used if the part of the foot pocket in which the seat 201 and the notch 301 are produced is made of rigid material, such as plastic.

Figure 3:
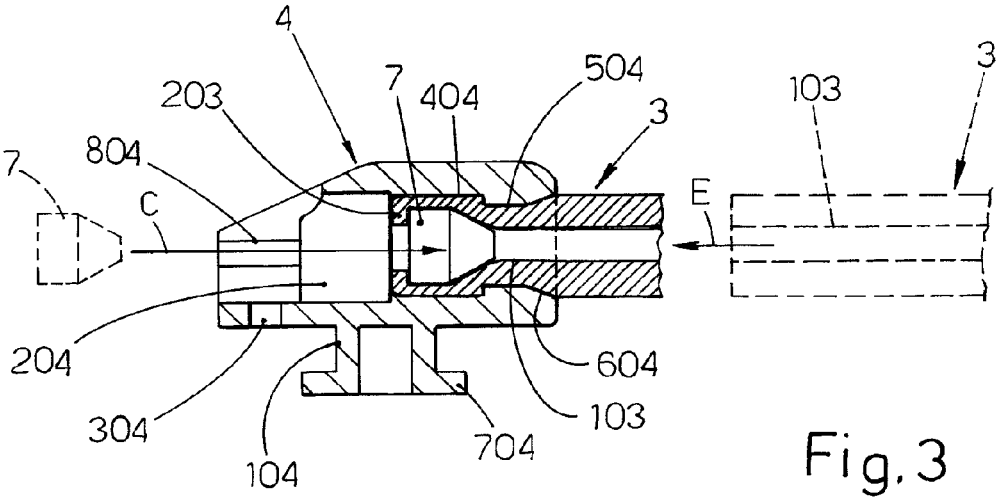
FIG. 3 is a longitudinal sectional view that shows a step of permanent fastening of an end of the elastomeric tubular element to the relevant end coupling element shown in FIG. 2.

This end coupling element 4, see FIG. 3, internally comprises a cylindrical seat 404 in which the end of the elastomeric tubular element 3 is inserted, see arrow E indicating the direction of insertion. This seat 404 comprises, on the side of insertion of the elastomeric tubular element 3, a constriction 504 through which a length of this elastomeric tubular element 3 passes, elastically compressed. Therefore, this constriction 504 will have a smaller diameter than the outer diameter of the elastomeric tubular element 3. After passing through the constriction 504, the elastomeric tubular element 3 expands once again. At the side of this constriction 504 the end coupling element 4 has a truncated cone shaped annular opening 604 that facilitates insertion of the end of the elastomeric tubular element 3. At this point, to prevent release of the end of the tubular element 3 housed in the end coupling element 4, the rigid wedge 7 is inserted inside the hole 103, thereby also elastically deforming the inside of the elastomeric tubular element 3. Advantageously, this wedge 7 is inserted in the direction C inside the elastomeric tubular element 3 by hand, thereby exerting a limited pressure and without using tools such as presses or the like. After the wedge 7 has been inserted into the hole 103, the tubular element 3 made of elastomeric material is fastened to the end coupling element 4 permanently and can no longer be removed. Following insertion of the wedge 7, an inner ring 203 is formed on the edge of the elastomeric tubular element 3 preventing accidental removal of the wedge 7 from the side on which it was inserted. In substance, the wedge 7, which has a larger outer diameter than the diameter of the inner hole 103, elastically expands this hole during its passage and, after it has passed through, the inner walls of the tubular element 3 tend to return elastically to the normal configuration, thereby forming the inner ring 203. Moreover, if the tubular element 3 is pulled in the opposite direction to the direction E of its insertion into the seat 404, this wedge 7 tends to become inserted increasingly in the hole 103 of the tubular element 3, therefore in the direction C, also passing beyond the corner of the constriction 504 with part of its truncated cone shaped tip. As can be seen, the maximum outer diameter of the wedge 7, besides being larger than the diameter of the through hole

103, must be approximately the same as the inner diameter of the constriction 504, so as to allow correct compression of the elastomeric tubular element 3 between the outer wall of the wedge 7 and the inner wall of the seat 204 and therefore of the constriction 504. Naturally, this outer diameter of the wedge 7 can be slightly larger or smaller than the diameter of the constriction 504, but it must allow correct compression of the length of elastomeric tubular element that has passed through the constriction 504, so that, in combination with this constriction, it can prevent release of the elastomeric tubular element 3. The present system for permanent coupling of the elastomeric tubular element 3 to the end coupling element 4 is therefore particularly efficient and stable, besides being put in place without any special tools.

Figure 4A:
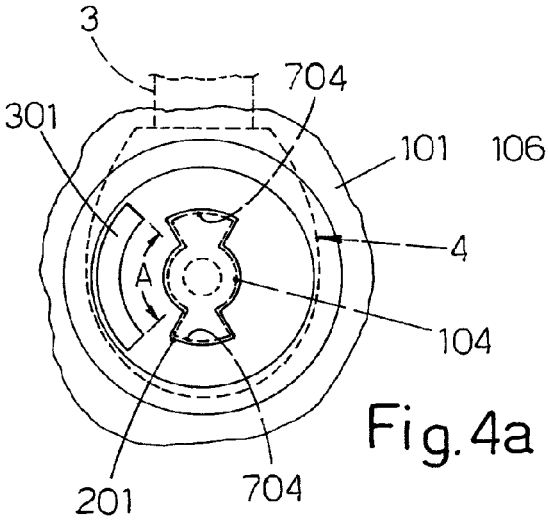
FIGS. 4*a* and 4*b* are two top views of one of the two end elements of the preceding figures that is inserted into a seat produced on the fin and rotated by approximately 90°.
Figure 4B:
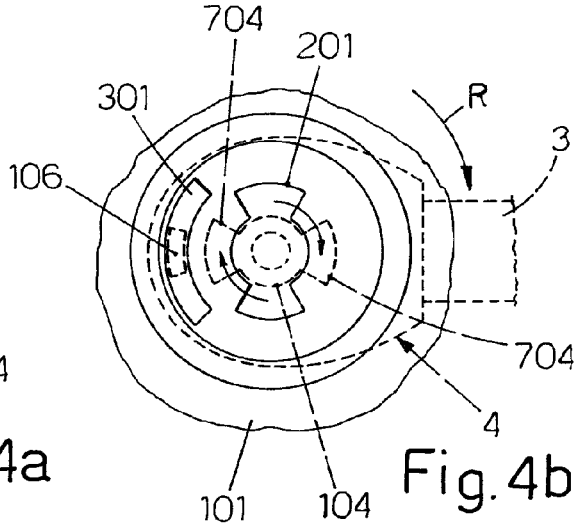

After both ends of the tubular element 3 have been fastened permanently to the relevant end element 4, as shown in FIG. 3, this end element 4 can be coupled and partially locked in position on the lateral wall of the foot pocket 101 of the fin, see FIGS. 4*a* and 4*b*. Firstly, the pin 104 of the end coupling element 4 is inserted through the hole 201 produced in the lateral wall of the foot pocket 101, so that the two tabs 704 pass through this hole 201 completely; then this end coupling element 4 is rotated in the direction R by approximately 90° so that said tabs 704 are positioned inside the surface of the lateral wall of the foot pocket 101. At this point, the end element 4 is coupled to the lateral wall of the foot pocket 101 of the fin.

Figure 6:
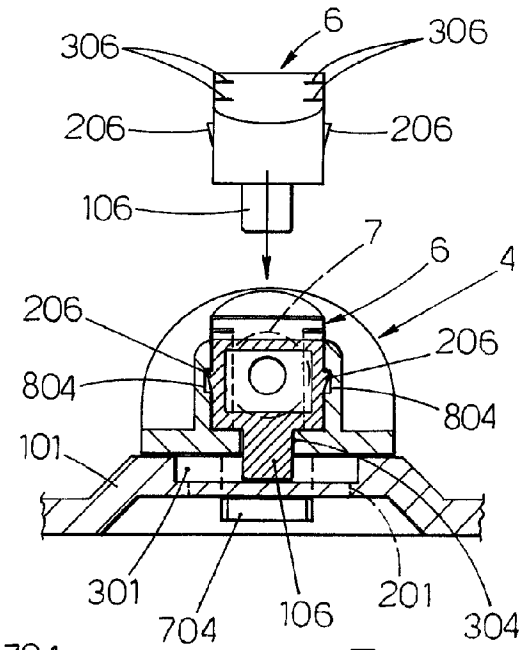
FIG. 6 is a sectional view along the line VI-VI of FIG. 5, which shows a front view of the hollow element for partial locking inserted into the end coupling element.
Figure 5:
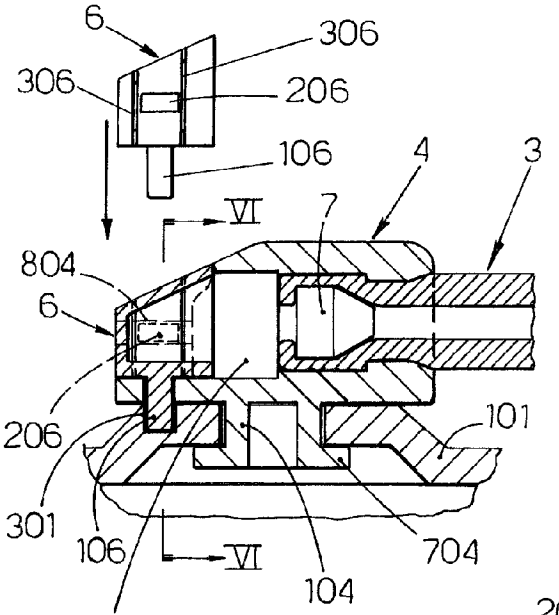
FIG. 5 is longitudinal sectional view showing the final element for partial locking before insertion into the end coupling element after insertion into this end coupling element.

To partially lock each of the end elements 4 in position in the corresponding holes 201 produced in opposite positions in the lateral walls of the foot pocket 101, see FIGS. 5 and 6, the final element 6 for partial locking is inserted into the seat 204 produced in the end coupling element 4. By also observing FIG. 2 together with FIGS. 5 and 6, it is more apparent how this final element 6 for partial locking is produced. This element 6 is a sort of hollow pin, provided on two opposite sides with two teeth 206 having a sloping lateral outer surface and a flat top surface, so that each of them can be snap-fitted into a corresponding groove 804 produced on the lateral wall of the seat 204 of the end coupling element 4, see also FIG. 3. To facilitate snap-fitting of these teeth 206 in the respective grooves 804, vertical slots 306 are produced at the sides thereof. These vertical slots 306 allow a certain degree of elastic bending towards the inside of the side panels of the element 6 for partial locking. This inward bending will stop when the teeth 206 are snap-fitted inside the respective grooves 804. Insertion of this element 6 for partial locking inside the relevant seat 204 of the end coupling element 4 causes the tooth 106 projecting from the bottom to be inserted in the relevant arc-shaped seat 301, after passing through the hole 304 produced in the seat 204 of the end coupling element 4.

The arc-shaped seat 301, in which the tooth 106 of the partial locking element 6 is housed, has the function of allowing a certain oscillating movement with the amplitude A, see FIGS. 4*a* and 4*b*, of each of the end coupling elements 4 with respect to the foot pocket 101. This seat 301 is produced at the side of the hole 201 in which the pin 104 with the relevant tabs 704 must be inserted. The amplitude A of this arc-shaped seat will be smaller than the rotation R useful to correctly position the two tabs 704 inside the foot pocket, so that, once coupling of the end elements 4 and partial locking thereof by means of the element 6 has been completed, the oscillating movement with the amplitude A that each of said end elements 4 can perform is limited and insufficient to permit a complete counter-rotation of the tabs 704 in the opposite direction to R, which would cause their undesired release from the relevant hole 201. Therefore, in substance, in this way the end coupling elements 4 remain partially locked in position due to the element 6, and, as stated above, can only oscillate with an amplitude A. This oscillation with the amplitude A is useful to make it easier for the user to put on a fin provided with the present strap and to allow a certain adjustment in height thereof. Therefore, the only way to remove each of the end coupling elements 4 from the foot pocket 101 of the fin is to remove the partial locking element 6 from the seat 204, forcing it to move upwards, then rotate each of the end elements by approximately 90° in the opposite direction to the arrow R of FIG. 4*b*, so that the tabs 704 are positioned aligned with the hole 201 of the foot pocket and therefore, ultimately, the end element 4 can be released therefrom.

Figure 7:
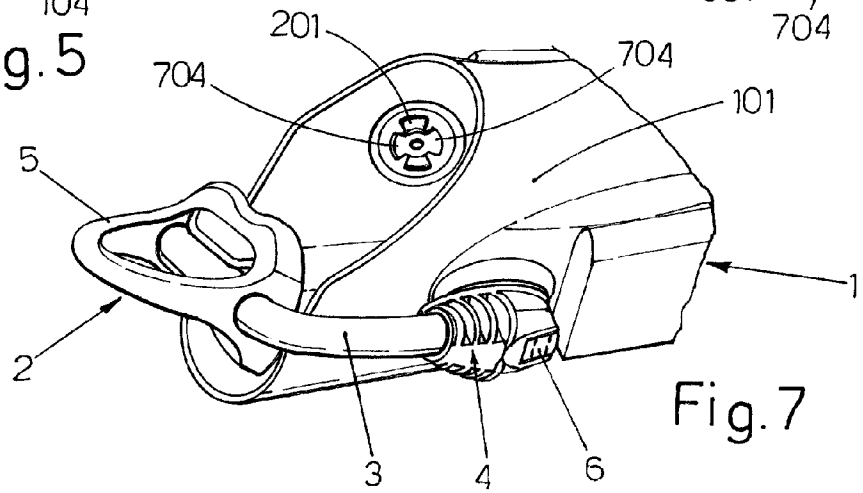
FIG. 7 is a perspective view showing the rear part of an open foot fin, to which there is fastened a strap provided with end coupling elements according to the preceding figures.

Therefore, to obtain optimal fastening of the strap to the foot pocket of the fin, according to the present invention the elastomeric tubular element 3 is fastened at each end and permanently to the end coupling element 4, each of the two end fastening elements 4 is inserted and rotated in a relevant seat 201 produced in the foot pocket of the fin and, after rotation, this end element 4 is partially locked in position by means of a final element 6 for partial locking, which therefore only allows a certain degree of oscillation. The present strap 2 will therefore be coupled and locked in the foot pocket 101 of the fin 1 as shown in FIG. 7. When wishing to remove the strap from the fin, the user only requires to remove the final element 6 for partial locking and to rotate the end coupling element 4 by approximately 90° in the opposite direction to release it from the seat 201. The end coupling elements 4 will in any case remain fastened to the ends of the tubular element 3 made of elastomeric material, as they are locked permanently in position by the wedge 7 and by the constriction 504.

In a second embodiment of the invention, the end coupling element 8 comprises a seat 208 having a larger amplitude with respect to the seat 204 of the first embodiment and is provided with a pin 9 for partial locking that is inserted from the inner part of the foot pocket 101 through the hole 201. This seat 208 is adapted to be closed by an upper cover 10 provided with projecting teeth 11 adapted to be snap-fitted in appropriate holes 12 produced on the walls of the seat 208 of the end coupling element 4. The end pin 9 for partial locking of the coupling element 8 to the fin comprises a head in which two recesses 109 are produced, diametrically opposite and of complementary shape to the tabs 708 of the pin 108 located under this end coupling element. Two diametrically opposite notches 209 are produced along the stem of this pin 9 and the end thereof is also provided with an annular step 309 for snap-fitting inside a through hole 908 produced inside the pin 108, see also FIG. 9. At the sides of the stem of this pin 9 there are also produced, in a position orthogonal to the recesses 109, two diametrically opposite ribs 409, adapted to be inserted into the two parts 501 of the seat 201 projecting radially and diametrically opposite. These ribs 409 housed in said parts 501 will allow a certain degree of oscillation of the end coupling element 8, once the pin 9 is in final position, as will be described below.

Figure 9:
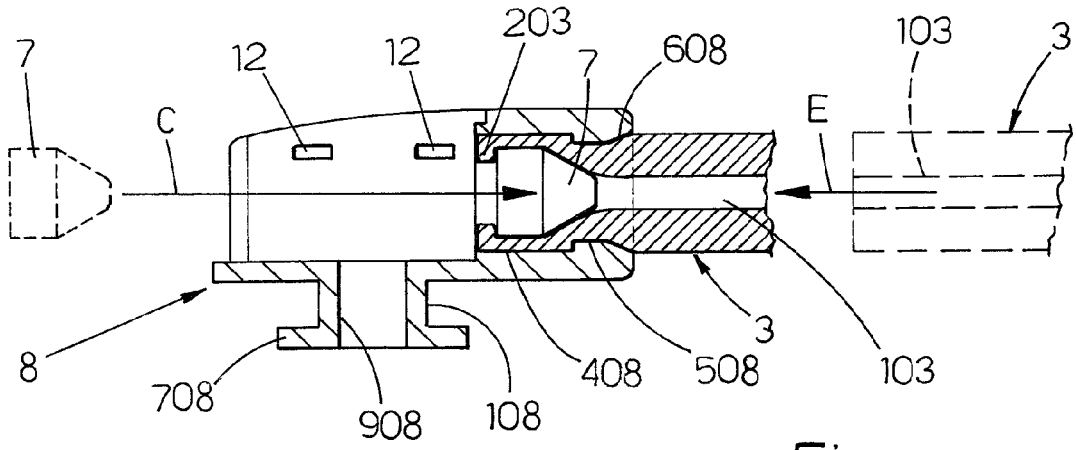
FIG. 9 is a longitudinal sectional view showing a step of permanent fastening of an end of the elastomeric tubular element to the relevant end coupling element shown in FIG. 8.

From FIG. 9 it can be noted how the fastening system of the cylindrical tubular element 3 made of elastomeric material to the end coupling element 8 is identical to the one shown in FIG. 3 relating to the first embodiment of said end element. Also in this case, advantageously, after insertion has taken place, the truncated cone shaped tip of the wedge 7 passes beyond the corner of the constriction 508 produced in the cylindrical seat 408 and is moved closer to the opening mouth 608. On the opposite side to that of the tip, insertion of the wedge 7 causes the formation of the inner ring 203 in the tubular element 3, which ensures correct positioning thereof. In practice, as in the previous embodiment, the inner ring 203 prevents the wedge 7 from exiting from the elastomeric tubular element 3 and the combined action of the wedge 7 and of the constriction 508 prevents the tubular element 3 from being removed from the end coupling element 8.

Figure 10A:
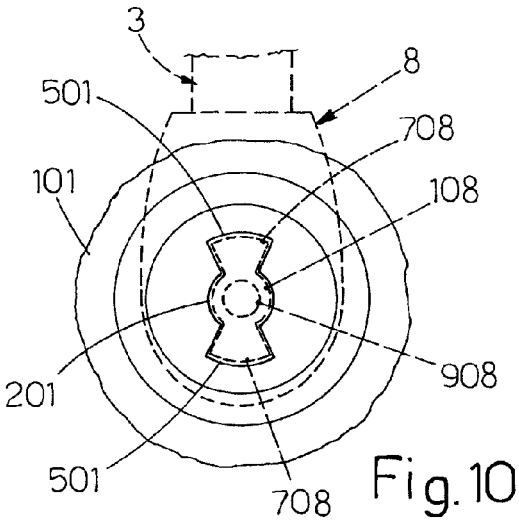
FIGS. 10*a* and 10*b* are two top views of one of the two end coupling elements produced as shown in FIG. 9, which is inserted into a seat produced on the fin and rotated by approximately 90°.
Figure 10B:
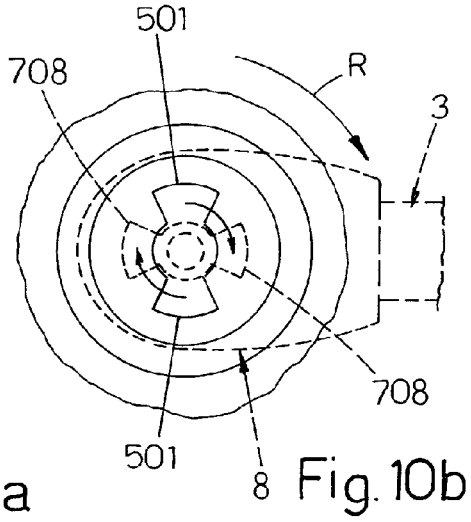
Figure 11:
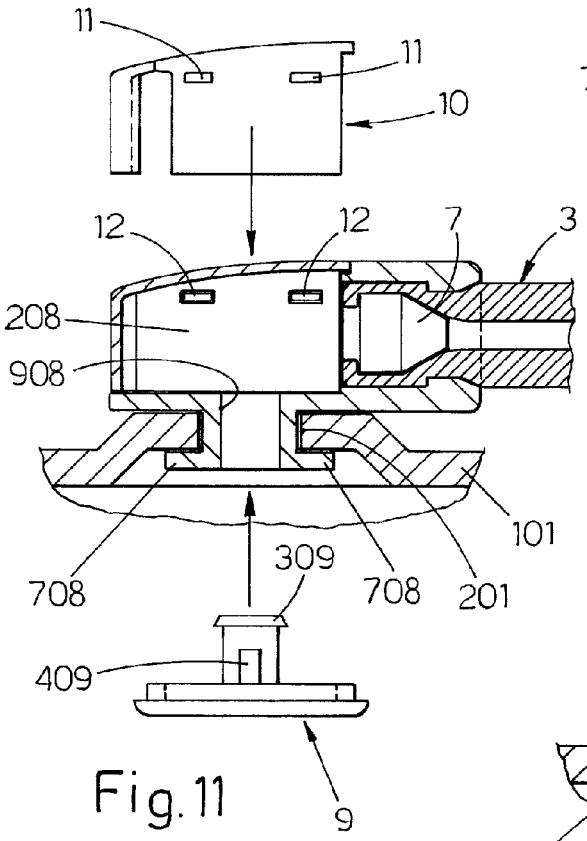
FIG. 11 is a longitudinal sectional view showing an end pin for partial locking adapted to be inserted into the end coupling element and a cover with which the end coupling element of the second embodiment is provided.

For correct positioning of the end coupling element 8 in the fin, see FIGS. 10*a* and 10*b*, the pin 108 is inserted inside the corresponding hole 201 so that the tabs 708 pass through it completely, then this end element 8 is rotated by 90° in the direction R, so as to substantially reach the situation of FIGS. 10*b* and 11. As can be seen from FIG. 10*b*, the tabs 708 are now positioned at 90° with respect to the holes 501 of corresponding shape to the seat 201 through which they have passed to be positioned inside the foot pocket 101.

Figure 8:
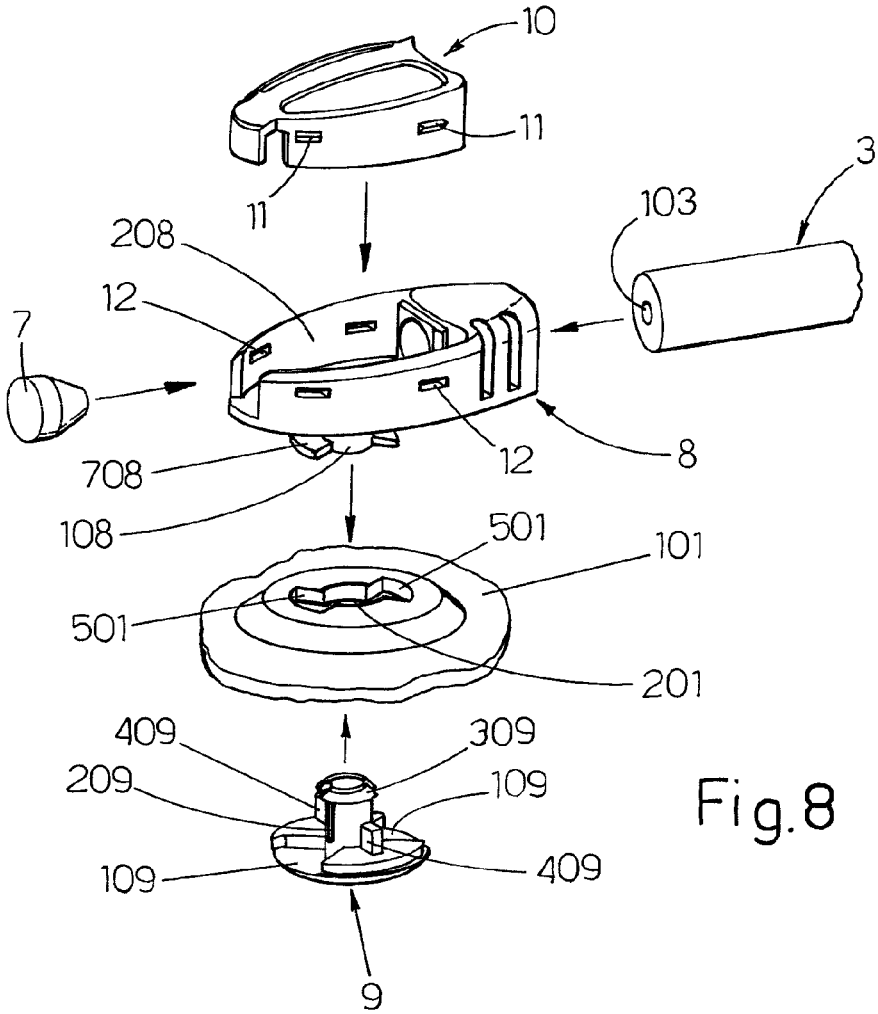
FIG. 8 is a perspective exploded view showing a second embodiment of the end elements for coupling the strap to the fin.
Figure 12:
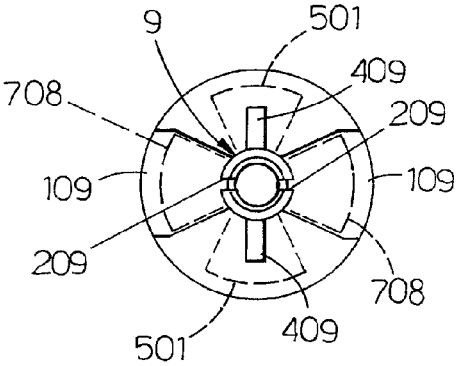
FIG. 12 is a bottom view of the end pin for partial locking of FIG. 11 inserted in position in the pin projected from the bottom of the end coupling element.
Figure 13:
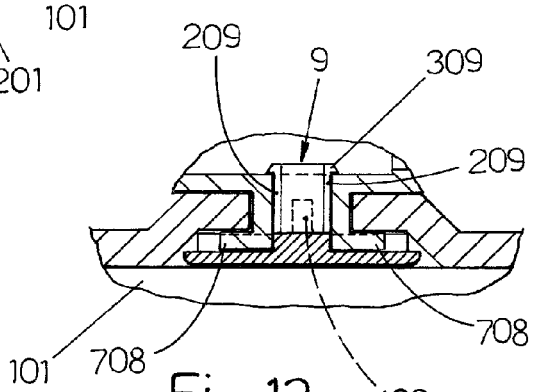
FIG. 13 is a partial longitudinal sectional view showing the end pin for partial locking of FIG. 11 and FIG. 12, correctly snap-fitted in the pin projecting from the bottom of the end coupling element.

At this point, with the end coupling element 8 correctly positioned in the foot pocket 101, see FIG. 11, the end pin 9 for partial locking of this end element 8 is inserted from the inside of the foot pocket 101 through the through hole 908, so that the annular edge 309 exits in the seat 208 of the end element 8 and the two recesses 109, see also FIGS. 8 and 12, substantially mate with the two tabs 708 of the pin 108. Naturally, the step of passage of the pin 9 inside the hole 908 is facilitated by the presence of the two notches 209 that allow a certain degree of elastic shrinkage of the stem of the pin 9. The pin 9 in the fully inserted position is shown in FIGS. 12 and 13. As mentioned previously, the two ribs 409 are housed in the parts 501 of the seat 201 through which the tabs 708 passed, and which are now free, so that in substance each of the end coupling elements 8 can oscillate with an amplitude equal to the amplitude of these parts 501. Once the end pin 9 has been inserted as described above, the cover 10 can be snap-fitted onto the seat 208 to protect the assembly.

Therefore, the present strap is particularly advantageous from the point of view of constructional simplicity, reliability and stability of the method of coupling to the foot pocket of the fin, this method, described in detail above, in any case advantageously allowing a certain degree of oscillation or rotation of the strap with respect to foot pocket but preventing its undesired release.

What is claimed is:

1. Heel strap for swimming fins with an open foot pocket, comprising a tubular element made of elastomeric material with a hole and end coupling elements for coupling to the foot pocket of the fin, characterised in that each end coupling element is provided with a seat in which at least one constriction is produced and through which, on one side, an end of the tubular element is inserted, which is consequently elastically compressed at said constriction and expands after passing through the same, there being inserted on the other side of said seat and of said constriction a locking element for locking the length of tubular element that has passed through said constriction in the hole, so as to elastically expand it and to prevent, in combination with said constriction, said tubular element from being separated from said end coupling elements which are thereby permanently coupled, said locking element being provided with an outer diameter that is approximately the same as the inner diameter of the constriction.

2. Heel strap according to claim 1, characterised in that, starting from the edge of said tubular element and following insertion of the locking element, an inner ring is formed upstream of said locking element inserted inside the hole, said inner ring being adapted to prevent release of the locking element from the elastomeric tubular element.

3. Heel strap according to claim 1, characterised in that said locking element is a wedge comprising a truncated cone shaped part facing the direction (C) of insertion of said elastomeric tubular element into the hole.

4. Heel strap according to claim 3, characterised in that said wedge, after being inserted into the elastomeric tubular element, is positioned with at least one length of the truncated cone shaped part beyond the constriction produced in said seat.

5. Heel strap according to claim 3, characterised in that each of said end coupling elements comprises a truncated cone shaped part to facilitate insertion of said tubular element made of elastomeric material.

6. Heel strap according to claim 1, characterised in that it comprises a final element, said end coupling elements comprising at least one pin provided with radially projecting tabs, said tabs being adapted to be inserted inside a seat produced in the foot pocket of the fin following a certain degree of rotation (R) of said end coupling element, each of said end coupling elements being provided with a seat for housing said final element, said final element being adapted to allow a certain degree of oscillation (A) of said end coupling elements and, at the same time, to prevent their release from said seat produced in the foot pocket.

7. Heel strap according to claim 6, characterised in that said final elements are provided with means for snap-fitting inside said seats of said end coupling elements.

8. Heel strap according to claim 6, characterised in that said final element comprises a pin adapted to be snap-fitted in said seat of the end coupling element on the opposite side with respect to the side on which said end coupling element is inserted into the seat produced in the foot pocket.

9. Heel strap according to claim 8, characterised in that said pin comprises on the stem at least one pair of diametrically opposite ribs adapted to engage in holes produced in diametrically opposite positions at the sides of the seat for passage of the pin, so as to allow a certain degree of oscillation of the end coupling elements.

10. Heel strap according to claim 6, characterised in that said final element comprises a tooth adapted to pass through a hole produced in the seat of the end coupling element and to be inserted in an arc-shaped seat produced on the wall of the open foot pocket, the amplitude of said arc-shaped seat corresponding to the amplitude of the permitted oscillation of said end coupling elements.

* * * * *